US007671817B2

(12) United States Patent
Moser

(10) Patent No.: US 7,671,817 B2
(45) Date of Patent: Mar. 2, 2010

(54) WIDEBAND ANTENNA

(75) Inventor: Michael Moser, Hägersten (SE)

(73) Assignee: Sony Ericsson Mobile Communications AB, Lund (SE)

( * ) Notice: Subject to any disclaimer, the term of this patent is extended or adjusted under 35 U.S.C. 154(b) by 186 days.

(21) Appl. No.: 11/679,442

(22) Filed: Feb. 27, 2007

(65) Prior Publication Data

US 2008/0204354 A1 Aug. 28, 2008

(51) Int. Cl.

| | |
|---|---|
| ***H01Q 1/00*** | (2006.01) |
| ***H01Q 21/00*** | (2006.01) |
| ***H01Q 1/36*** | (2006.01) |
| ***H01Q 13/00*** | (2006.01) |

(52) U.S. Cl. ..... 343/828; 343/829; 343/825; 343/908; 343/773

(58) Field of Classification Search ..... 343/702, 343/896, 897, 898, 899, 825, 828, 829, 908, 343/846, 848, 773, 786

See application file for complete search history.

(56) References Cited

U.S. PATENT DOCUMENTS

| | | | | |
|---|---|---|---|---|
| 2,659,002 | A | 11/1953 | Keeler | |
| 3,401,387 | A | 9/1968 | Milligan et al. | |
| 7,023,397 | B2 * | 4/2006 | Kurashima et al. | 343/845 |
| 7,027,002 | B2 * | 4/2006 | Suh et al. | 343/773 |
| 2006/0181471 | A1 * | 8/2006 | Kim et al. | 343/767 |
| 2008/0252536 | A1 * | 10/2008 | Anguera et al. | 343/702 |

FOREIGN PATENT DOCUMENTS

| | | |
|---|---|---|
| EP | 0 766 343 A2 | 4/1997 |
| JP | 2005-252526 | 9/2005 |
| WO | WO 03/034538 A1 | 4/2003 |

OTHER PUBLICATIONS

International Search Report issued for corresponding application no. PCT/EP2007/058701, mailed Feb. 4, 2008, 4 pages.

* cited by examiner

*Primary Examiner*—Douglas W Owens
*Assistant Examiner*—Jennifer F Hu
(74) *Attorney, Agent, or Firm*—Harrity & Harrity, LLP

(57) ABSTRACT

An antenna arrangement for a communication device is provided that may include a monopole antenna element having a bottom side joined to a first lateral side and joined to a second lateral side. The bottom side may be joined to each lateral side at an angle less than 90 degrees for forming an antenna element area defined at least by the bottom side and the first and second lateral sides. The antenna element area may include an central part arcuate around a longitudinal axis in a conical fashion, so that at least a part of the bottom side is provided half a turn around the longitudinal axis.

20 Claims, 3 Drawing Sheets

WIDEBAND ANTENNA

TECHNICAL FIELD OF THE INVENTION

The present invention relates to antennas and, more particularly, to antenna systems for communication devices, as well as to communication devices having such antenna systems.

DESCRIPTION OF RELATED ART

Portable communication devices, such as cellular phones, are becoming increasingly smaller and more compact. For many reasons, the antennas of such devices are often disposed inside the device. Consequently, the antennas also have to be of limited dimensions.

At the same time, the various frequency bands to be used by such devices are expanding. As a result, the small antennas need to operate over wider and wider frequency bands. In the case of cellular phones, for example, typical devices cover frequency ranges that include the lowest GSM frequency as well as the highest UMTS frequency. It is thus desirable to cover ranges from 824-2170 MHz, while maintaining a good efficiency over the entire range of bands. This is not a simple task to solve in a small sized portable communication device.

Thus, a need exists for small antennas that provide good efficiency over a large frequency band.

SUMMARY OF THE INVENTION

The present invention is generally directed to providing an antenna arrangement having reduced dimensions, configured to reside inside a portable communication device and configured to provide superior operating properties for the frequencies that are of interest.

Implementations of the present invention provide an antenna arrangement for a communication device, which is small enough to fit inside the device and still maintain superior antenna properties over a range of frequencies.

According to a first aspect of the present invention, an antenna arrangement for a portable communication device includes a monopole antenna element having a bottom side at a first end joined to a first end of a first lateral side and at an opposite second end joined to a first end of a second lateral side, where the bottom side is joined to each lateral side at an angle that is below ninety degrees for forming an antenna element area defined at least by the bottom side and the first and second lateral sides, wherein the antenna element area includes a central part that is halfway curved around a longitudinal axis in a conical fashion, so that at least a part of the bottom side is provided half a turn around the longitudinal axis.

A second aspect of the present invention is directed to an antenna arrangement including the features of the first aspect, wherein the lateral sides are parallel with the longitudinal axis.

A third aspect of the present invention is directed to an antenna arrangement including the features of the first aspect, wherein the first lateral side has a second end and the second lateral side has a second end.

A fourth aspect of the present invention is directed to an antenna arrangement including the features of the third aspect, wherein the second end of the first lateral side is joined to the second end of the second lateral side in order to define the antenna element area.

A fifth aspect of the present invention is directed to an antenna arrangement including the features of the third aspect, further comprising an upper side, which is at a first end joined to the second end of the first lateral side and at a second end to the second end of the second lateral side in order to define the antenna element area.

A sixth aspect of the present invention is directed to an antenna arrangement including the features of the third aspect, further including a feeding section joined with and stretching out from a lateral side adjacent the bottom side.

A seventh aspect of the present invention is directed to an antenna arrangement including the features of the sixth aspect, further including at least one tuning section joined with and stretching out from a lateral side.

An eighth aspect of the present invention is directed to an antenna arrangement including the features of the seventh aspect, wherein the tuning section is provided between the feeding section and the second end of the lateral side.

A ninth aspect of the present invention is directed to an antenna arrangement including the features of the sixth aspect, further including a matching unit connected to the feeding section.

A tenth aspect of the present invention is directed to an antenna arrangement including the features of the first aspect, wherein the antenna element area includes a first and a second planar part provided on opposite sides of the central part.

Implementations of the present invention provide a portable communication device having an antenna arrangement that is small, can be provided inside the device and still has good antenna properties for the frequencies that are of interest.

According to an eleventh aspect of the present invention, a portable communication device includes: a ground plane; a radio circuit; and a monopole antenna element having a bottom side at a first end joined to a first end of a first lateral side and at an opposite second end joined to a first end of a second lateral side, where the bottom side is joined to each lateral side at an angle that is below ninety degrees for forming an antenna element area defined at least by the bottom side and the first and second lateral sides, wherein the antenna element area includes a central part that is halfway curved around a longitudinal axis in a conical fashion, so that at least a part of the bottom side is provided half a turn around the longitudinal axis.

A twelfth aspect of the present invention is directed to a portable communication device including the features of the eleventh aspect, wherein the monopole antenna element is placed sideways in relation to the ground plane.

A thirteenth aspect of the present invention is directed to a portable communication device including the features of the eleventh aspect, wherein the lateral sides are parallel with the longitudinal axis.

A fourteenth aspect of the present invention is directed to a portable communication device including the features of the eleventh aspect, wherein the first lateral side has a second end and the second lateral side has a second end.

A fifteenth aspect of the present invention is directed to a portable communication device including the features of the fourteenth aspect, wherein the second end of the first lateral side is joined to the second end of the second lateral side in order to define the antenna element area.

A sixteenth aspect of the present invention is directed to a portable communication device including the features of the fourteenth aspect, further including an upper side, which is at a first end joined to the second end of the first lateral side and at a second end to the second end of the second lateral side in order to define the antenna element area.

A seventeenth aspect of the present invention is directed to a portable communication device including the features of the fourteenth aspect, further including a feeding section joined with and stretching out from a lateral side adjacent the bottom side.

An eighteenth aspect of the present invention is directed to a portable communication device including the features of the seventeenth aspect, further including at least one tuning section joined with and stretching out from a lateral side towards the ground plane.

A nineteenth aspect of the present invention is directed to a portable communication device including the features of the eighteenth aspect, wherein the tuning section is provided between the feeding section and the second end of the lateral side.

A twentieth aspect of the present invention is directed to a portable communication device including the features of the seventeenth aspect, further including a matching unit connected between the feeding section and the radio circuit.

A twenty-first aspect of the present invention is directed to a portable communication device including the features of the eleventh aspect, wherein the antenna element area includes a first and a second planar part provided on opposite sides of the central part.

A twenty-second aspect of the present invention is directed to a portable communication device including the features of the eleventh aspect, wherein the portable device is a cellular phone.

Implementations of the present invention provide a number of advantages. For example, a small sized antenna arrangement may be provided inside a portable communication device and still have good antenna properties for a wide frequency range. Implementations of the present invention are less susceptible to fabrication errors and manufacturing tolerances. Implementations of the present invention may be less affected, during operation, to orientation of the portable communication device in which they reside. Implementations of the present invention may be of simple design and produced at a relatively low cost. Implementations of the present invention may conform to the dimensions of compact devices in which they reside.

It should be appreciated that the terms "comprises/comprising" and/or "includes/including," when used in this specification, are taken to specify the presence of stated features, integers, steps or components, but do not preclude the presence or addition of one or more other features, integers, steps, components or groups thereof.

BRIEF DESCRIPTION OF THE DRAWINGS

The present invention will now be described in more detail in relation to the enclosed drawings, in which.

DETAILED DESCRIPTION OF EMBODIMENTS

Figure 1:
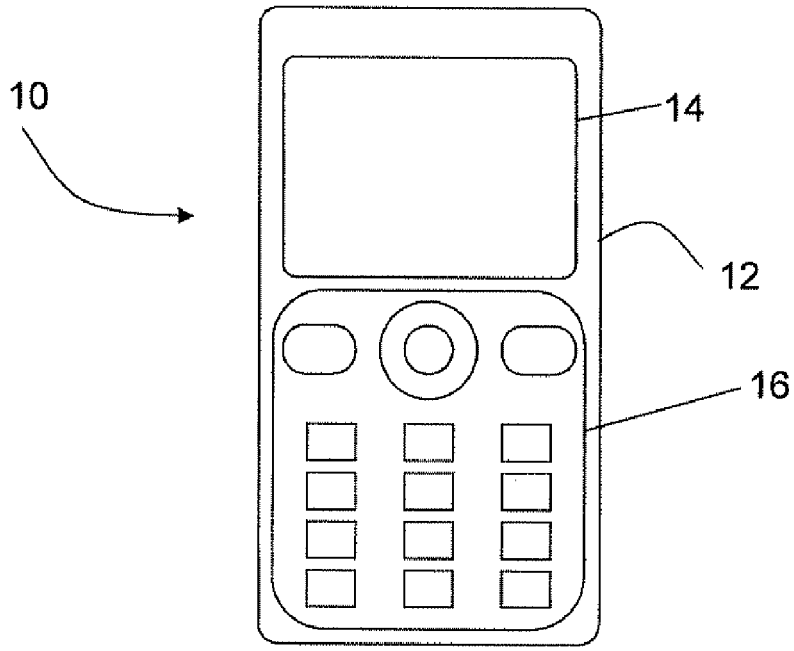
FIG. 1 shows a front view of an exemplary device in which systems and methods of the present invention may be implemented.

FIG. 1 shows a front view of a communication device 10 in the form of a cellular phone. Communication device 10 may include a casing 12 that may house a keypad 16 and a display 14. Keypad 16 may include a number of keys that are used for operating communication device 10, e.g., inputting information by a user of communication device 10. Communication device 10 may include other input mechanisms. Other functional units of communication device 10 may be provided in an interior of communication device 10, i.e., inside casing 12.

Communication device 10 may include at least one antenna arrangement, which according to one implementation of the invention, may be provided in the interior of communication device 10, i.e., inside casing 12. It should appreciated that the communication device 10 according to the present invention is not limited to a cellular phone, but may include any mobile terminal, such as a lap top computer, a palm top computer, and the like.

Figure 2:
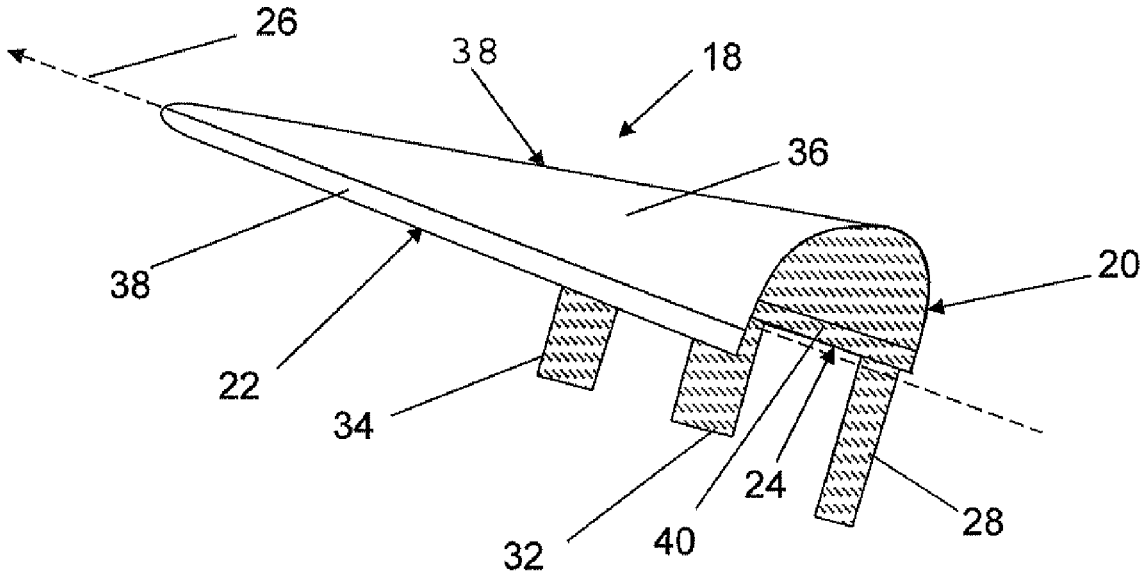
FIG. 2 shows a perspective view of an antenna arrangement according to an embodiment of the present invention.

FIG. 2 shows a perspective view of an antenna arrangement 18 according to one embodiment of the present invention. Antenna arrangement 18 may include a monopole antenna element that has a main section that may include a central part 36 and first and second lateral parts 38 and 40, collectively, an antenna element area 36, 38, 40, having a bottom side 20, which, at a first end, may be adjacent to a first end of a first lateral side 22. Bottom side 20 may be disposed at an opposite second end adjacent to a first end of a second lateral side 24. Lateral sides 22 and 24 may be substantially straight or flat. Bottom side 20 may be adjacent to each of lateral sides 22 and 24 at an angle that is less than ninety degrees, for example. Other angles are possible.

First and second lateral sides 22 and 24 may include second ends, which, in one embodiment, are joined. As described, antenna element area 36, 38, 40 may be defined by three or more sides, e.g., bottom side 20, and lateral sides 22 and 24. Antenna element area 36, 38, 40 may be divided into central part 36 and first and second lateral parts 38 and 40, where first and second lateral parts 38 and 40 are provided on opposite sides of central part 36. Each of the parts of antenna element area 36, 38 and 40 may extend from bottom side 20 to a point where the second ends of lateral sides 22 and 24 are joined.

In one implementation, central part 36 may be halfway curved around a longitudinal axis 26, for example, in a conical shape, so that at least a part of bottom side 20 is provided half a turn around longitudinal axis 26. In other words, central part 36 may be essentially formed as a cone that has been split through the middle or bisected along longitudinal axis 26. First and second lateral parts 38 and 40 may be substantially planar and without curvature, and may extend away from central part 36 perpendicular to the plane in which the split is provided. The distance from the top to the base of the structure having a split cone-like shape may in some instances be approximately equal to ⅛ of the wavelength of the lowest frequency in a frequency range that is of interest. Other distances are possible. For example, approximately equal to ½, ¼, ⅙, 1/10, or other fraction of the wavelength of the lowest frequency in a frequency range that is of interest.

First and second lateral sides 22 and 24 may be parallel to longitudinal axis 26. Antenna arrangement 18 may include a feeding section 28, which, in one embodiment, may be joined with second lateral side 24. Feeding section 28 may be joined with lateral side 24 adjacent bottom side 20. Feeding section 28 may be joined with lateral side 24 at a point where lateral sides 20 and 24 meet, or, alternatively, may be spaced a distance from the junction, for example, as is shown in FIG. 2. Antenna arrangement 18 may include a first and a second tuning section 32 and 34 that may be joined to second lateral side 24. Feeding section 28, and tuning sections 32 and 34 may be co-planar with second lateral part 40. Antenna arrangement 18 may be made from a conductive material, for example, a metal, e.g., copper. Other materials are possible.

Figure 3:
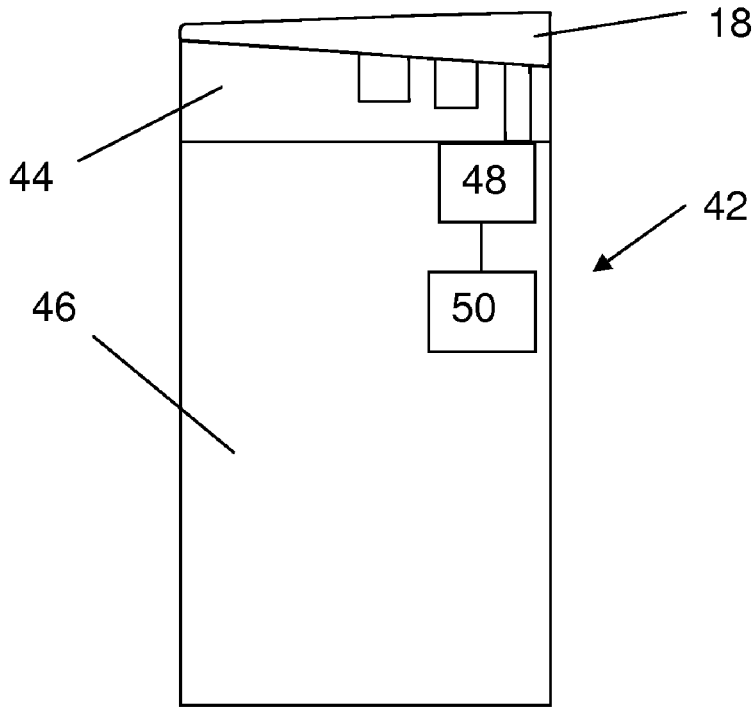
FIG. 3 shows a front view of a circuit board provided with the antenna arrangement of FIG. 2 and other components.
Figure 4:
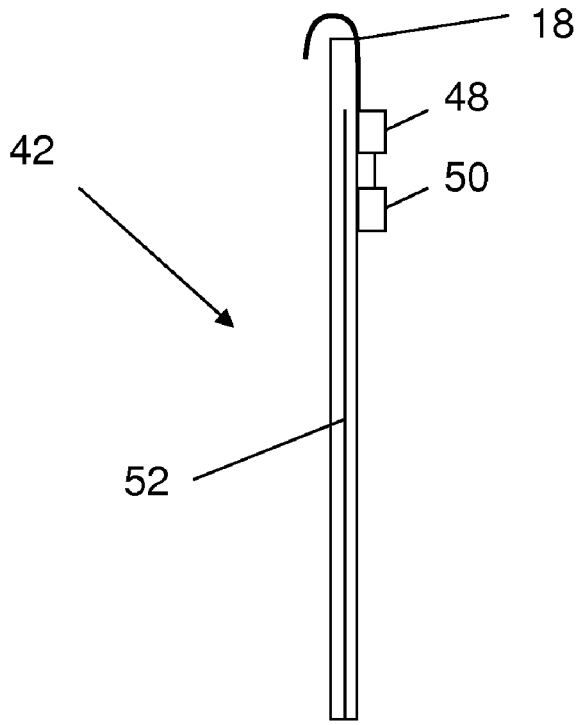
FIG. 4 shows a side view of the circuit board of FIG. 3.

FIG. 3 shows a front view of antenna arrangement 18 provided on a circuit board 42. FIG. 4 shows a side view of antenna arrangement 18 on circuit board 42. Circuit board 42, for example, may be divided into two sections, a circuit section 46 and an antenna section 44. In one implementation, antenna section 44 does not include a ground plane and/or any other components or other electrical circuits that may influence antenna arrangement 18 in antenna section 44. Circuit section 46 may include a ground plane 52. Ground plane 52 may be disposed within circuit board 42. Alternatively, ground plane 52 may be partially or entirely disposed on or near a surface of the board 42.

Circuit board 42 may connect to a number of electrical elements. In FIGS. 3 and 4, two elements, a radio circuit 50 and a matching unit 48, are as shown as connecting to circuit board 42. It will be appreciated that circuit board 42 may have several other elements mounted on it, which have been omitted for purposes of discussion.

Feeding section 28 of antenna arrangement 18 may extend from lateral side 24 to which it is joined, and connect to matching unit 48. Matching unit 48 may connect to radio circuit 50. Other configurations are possible.

As can be seen from FIGS. 3 and 4, tuning sections 32 and 34 of antenna arrangement 18 may extend from lateral side 24, to which sections 32 and 34 are joined, in a direction toward circuit section 46 of circuit board 42 and toward ground plane 52. In one implementation, antenna arrangement 18 may be disposed at a distance from ground plane 52 and in a plane in which ground plane 52 is provided. For example, tuning sections 32 and 34 may be disposed on a side of ground plane 52, i.e., sideways in relation to ground plane 52.

Figure 5:
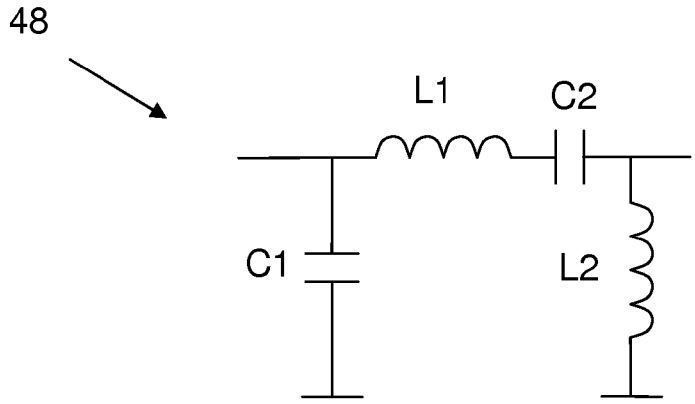
FIG. 5 shows a circuit diagram of a matching unit according to one implementation of the present invention.

FIG. 5 shows matching unit 48 that is suitable for use with antenna arrangement 18 according to one implementation of the present invention. Matching unit 48 may include a first capacitor C1. First capacitor C1 may be disposed at a first end connected to ground and at a second end connected to a first end of a first inductor L1. The connection point between first capacitor C1 and first inductor L1 may connect to radio circuit 50 for supplying and receiving radio signals. A second end of first inductor L1 may connect to a first end of a second capacitor C2. Second capacitor C2 may include a second end connected to a first end of a second inductor L2. A second end of second inductor L2 may connect to ground. The connection point between second capacitor C2 and second inductor L2 may connect to feeding section 28 of antenna arrangement 18. The values of the components of matching unit 48 may be selected so that unit 48 aids the performance of antenna arrangement 18 by matching antenna arrangement 18 to the frequency range(s) of interest.

Currently, portable communication devices are typically configured to operate using relatively wide frequency bands. In the case of cellular phones, for example, an antenna should be configured to cover various GSM, PCS, and/or UMTS frequency bands. With respect to these exemplary frequency bands, the antenna should be configured to cover frequencies ranging from about 824 MHz to about 2170 MHz, while maintaining an acceptable level of performance.

Figure 6:
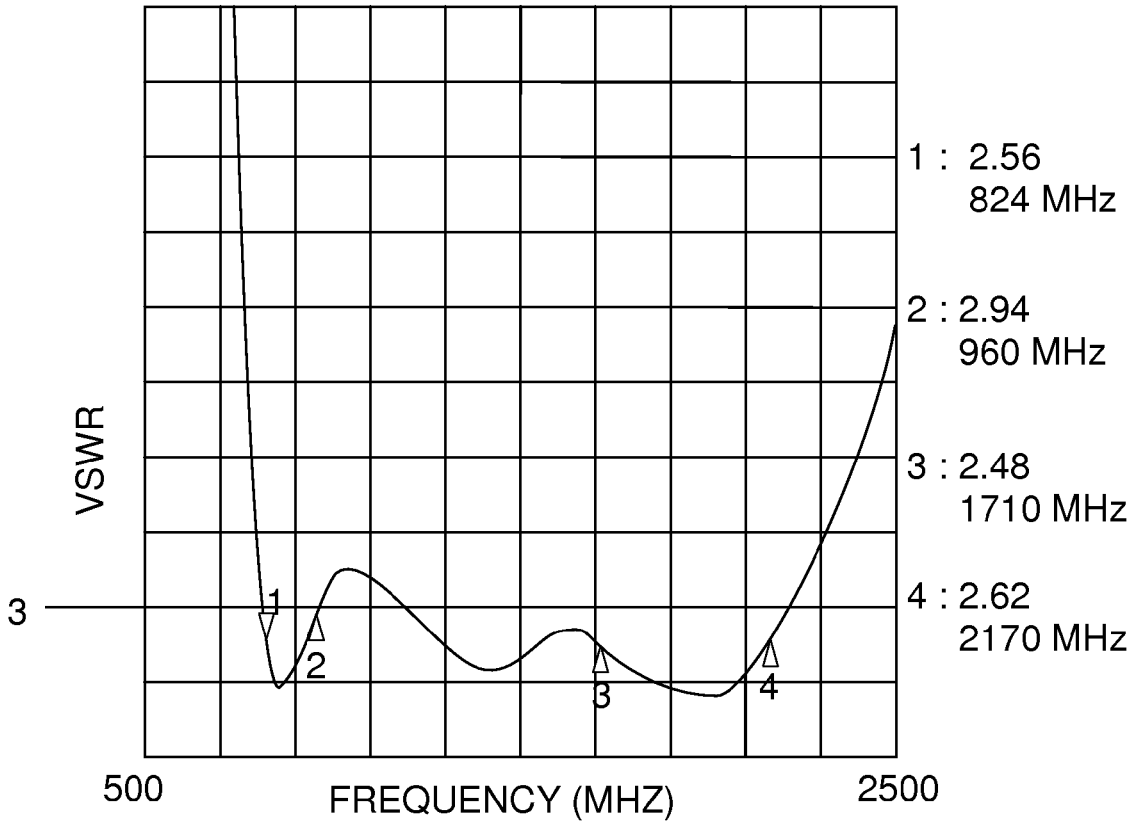
FIG. 6 shows an exemplary graph of VSWR (voltage standing wave ratio) vs. frequency associated with operation an antenna arrangement according to FIG. 2.

Implementations of an antenna, according to the present invention, provide an optimal level of performance, as can be seen from FIG. 6, which shows a plot of VSWR (voltage standing wave ratio) relative to frequency for the antenna according one implementation of the present invention. The scale used on the horizontal axis in FIG. 6 is 200 MHz per unit (starting at 500 MHz and ending at 2500 MHz). The scale used on the vertical axis in FIG. 6 is ranging from 1 to 11. In the plot, a few exemplary points are furthermore marked, where a first point 1 is provided for the frequency 824 MHz, a second point 2 provided for the frequency 960 MHz, a third point 3 is provided for the frequency 1710 MHz and a fourth point 4 is provided for the frequency 2170 MHz. Here first and second points 1 and 2 give a first range which corresponds to lower GSM frequencies, while third and fourth points 3 and 4 give a second range which corresponds to higher GSM frequencies, PCS frequencies, and/or UMTS frequencies.

As can be seen in FIG. 6, the performance associated with operation using an implementation of the present invention is good over the entire range of 824-2170 MHz. As can be seen in FIG. 6, the efficiency is very good (e.g., below 3) within the first and the second range and only slightly above 3 in a short range from about 960 to about 1150 MHz. The efficiency is thus very good in the entire range from about first point 1 to about fourth point 4, which corresponds to a frequency range that is of particular interest in existing mobile terminals and the like.

Tuning sections 32, 34 of antenna arrangement 18 in FIG. 2 may have a limited influence on the plot in FIG. 6. The disposition and placement of tuning sections 32, 34 along the lateral side of antenna arrangement 18 may influence the steepness of the plot in various sections, for example, around second point 2 of the plot. It is therefore possible to vary the steepness of sections of the plot through varying the positions of tuning sections 32, 34 along the lateral side of antenna arrangement 18. As such, antenna arrangement 18 may be configured (e.g., fine-tuned) to meet specific requirements relative to selected frequencies of particular interest.

Antenna arrangements according to the present invention, such as antenna arrangement 18, have a number of further advantages. For example, some implementations are comparatively less sensitive to fabrication errors and manufacturing tolerances. Some implementations are comparatively less sensitive to variations in orientation during operation of the mobile phones in which they are used. Some implementations may occupy a limited space in the mobile phones in which they reside. Some implementations are comparatively less complex and readily produced at comparatively low cost.

The present invention may be varied in any number of ways. For example, it should be appreciated that the antenna element area need not include, for instance, the lateral parts. It should also be appreciated that antenna arrangement 18 may be provided without some of the above-described components, such as the tuning sections. Antenna arrangement 18 may only include one tuning section, or, alternatively, two or more tuning sections. The tuning elements and the feeding elements may connect to any of the lateral sides. The tuning elements and the feeding elements need not connect to the same lateral side. Antenna arrangement 18 need not be provided as a split solid cone-like structure, but may be provided, for example, as a split truncated cone-like structure, or any other suitable structure. For example, antenna arrangement 18 may be provided with an upper side 38, which would at a first end be joined to the second end of the first lateral side and at a second end be joined to the second end of the second lateral side. As such, the antenna element area may be defined by the bottom, upper, and first and second lateral sides. Other configurations are possible.

Matching unit 48 can also be modified from that which has been described. For example, one or both of the inductance elements may be omitted. The invention is furthermore in no way limited to the frequency ranges mentioned above, but may be applied for any suitable frequency range. Therefore, the present invention is only to be limited by the following claims.

What is claimed is:

1. An antenna arrangement for a portable communication device, comprising:

a monopole antenna element including:

a central part having an upper side and an opposing bottom side, and a top end and an opposing base end, where a width of the central part at the base end is greater than a width of the central part at the top end, a first lateral side joined to a first lengthwise edge of the central part, and a second lateral side joined to a second lengthwise edge of the central part, where the central part is partially curved around a longitudinal axis, so that at least a portion of the bottom side is provided one half turn round the longitudinal axis, and the first and second lateral sides are lengthwise parallel to the longitudinal axis, to define an antenna element in the form of a truncated cone-like structure bisected along the longitudinal axis.

2. The antenna arrangement of claim 1, where the first lateral side and the second lateral side extend from the central part perpendicularly to a plane in which the truncated cone-like structure is bisected.

3. The antenna arrangement of claim 2, where the the first lateral side and the second lateral side extend to a point beyond the one half turn around the longitudinal axis.

4. The antenna arrangement of claim 2, where the first lateral side and the second lateral side are joined to the central part at a juncture of the upper side and the bottom side.

5. The antenna arrangement of claim 1, further comprising:

a feeding section joined with and extending from the first lateral side adjacent the bottom side.

6. The antenna arrangement of claim 5, further comprising:

at least one tuning section joined with and extending from the first lateral side.

7. The antenna arrangement of claim 6, where the at least one tuning section is provided between the feeding section and an end of the first lateral side.

8. The antenna arrangement of claim 5, further comprising:

a matching unit connected to the feeding section.

9. The antenna arrangement of claim 1, where the first lateral side comprises a first substantially planar part and the second lateral side comprises a second substantially planar part provided on opposite sides of the central part.

10. A communication device comprising:

a ground plane;

a radio circuit; and a monopole antenna element including:

a central part having an upper side and an opposing bottom side, and a top end and an opposing base end, where a width of the central part at the base end is greater than a width of the central part at the top end, a first lateral side joined to a first lengthwise edge of the central part, and a second lateral side joined to a second lengthwise edge of the central part, where the central part is at least partially curved around a longitudinal axis, so that at least a portion of the bottom side is provided a half turn around the longitudinal axis, and the first and second lateral sides are lengthwise parallel to the longitudinal axis, to define an antenna element in the form of a truncated cone-like structure bisected along the longitudinal axis.

11. The communication device of claim 10, where the monopole antenna element is disposed sideways relative to the ground plane.

12. The communication device of claim 10, where the first lateral side and the second lateral side extend from the central part perpendicularly to a plane in which the truncated cone-like structure is bisected.

13. The communication device of claim 12, where the the first lateral side and the second lateral side extend to a point beyond the half turn around the longitudinal axis.

14. The communication device of claim 12, where the first lateral side and the second lateral side are joined to the central part at a juncture of the upper and bottom sides.

15. The communication device of claim 12, further comprising a feeding section joined with and extending from the first lateral side adjacent the bottom side.

16. The communication device of claim 15, further comprising:

at least one tuning section joined with and extending from the first lateral side towards the ground plane.

17. The communication device of claim 16, where the tuning section is provided between the feeding section and an end of the first lateral side.

18. The communication device of claim 15, further comprising:

a matching unit connected to the feeding section and the radio circuit.

19. The communication device of claim 10, where the first lateral side comprises a first substantially planar part and the second lateral side comprises a second substantially planar part provided on opposite sides of the central part.

20. The communication device of claim 10, where the communication device comprises a cellular phone.

* * * * *

UNITED STATES PATENT AND TRADEMARK OFFICE

CERTIFICATE OF CORRECTION

PATENT NO. : 7,671,817 B2
APPLICATION NO. : 11/679442
DATED : March 2, 2010
INVENTOR(S) : Michael Moser It is certified that error appears in the above-identified patent and that said Letters Patent is hereby corrected as shown below:

Column 7, Line 18 should read: "bottom side is provided one half turn around the".

Signed and Sealed this

Thirteenth Day of April, 2010

David J. Kappos

David J. Kappos
*Director of the United States Patent and Trademark Office*